US007520312B2

(12) United States Patent
Memmen

(10) Patent No.: US 7,520,312 B2
(45) Date of Patent: Apr. 21, 2009

(54) INVESTMENT CASTING

(75) Inventor: Robert L. Memmen, Cheshire, CT (US)

(73) Assignee: United Technologies Corporation, Hartford, CT (US)

( * ) Notice: Subject to any disclaimer, the term of this patent is extended or adjusted under 35 U.S.C. 154(b) by 121 days.

(21) Appl. No.: 11/333,967

(22) Filed: Jan. 17, 2006

(65) Prior Publication Data

US 2008/0006384 A1 Jan. 10, 2008

Related U.S. Application Data

(62) Division of application No. 10/891,660, filed on Jul. 14, 2004, now Pat. No. 7,172,012.

(51) Int. Cl.
*B22C 9/04* (2006.01)

(52) U.S. Cl. ..... 164/45; 164/516; 164/369

(58) Field of Classification Search ..... 164/45, 164/516, 369
See application file for complete search history.

(56) References Cited

U.S. PATENT DOCUMENTS

| | | | | |
|---|---|---|---|---|
| 6,556,411 | B1 * | 4/2003 | Hoeft et al. | 361/119 |
| 7,124,546 | B2 * | 10/2006 | Scharff et al. | 52/314 |
| 7,172,012 | B1 * | 2/2007 | Memmen | 164/45 |
| 2005/0087319 | A1 * | 4/2005 | Beals et al. | 164/45 |

FOREIGN PATENT DOCUMENTS

| | | | |
|---|---|---|---|
| EP | 1 358 954 | * | 11/2003 |
| WO | WO 99/02431 | * | 4/1999 |

* cited by examiner

*Primary Examiner*—Kevin P Kerns
(74) *Attorney, Agent, or Firm*—Bachman & LaPointe, P.C.

(57) ABSTRACT

An investment casting pattern component has a spine and a number of tines extending from the spine.

21 Claims, 4 Drawing Sheets

INVESTMENT CASTING

CROSS REFERENCE TO RELATED APPLICATION

This is a divisional application of Ser. No. 10/891,660, filed Jul. 14, 2004, now U.S. Pat. No. 7,172,012, and entitled INVESTMENT CASTING, the disclosure of which is incorporated by reference herein as if set forth at length.

BACKGROUND OF THE INVENTION

The invention relates to investment casting. More particularly, the invention relates to the forming of core-containing patterns for investment forming investment casting molds.

Investment casting is a commonly used technique for forming metallic components having complex geometries, especially hollow components, and is used in the fabrication of superalloy gas turbine engine components.

Gas turbine engines are widely used in aircraft propulsion, electric power generation, ship propulsion, and pumps. In gas turbine engine applications, efficiency is a prime objective. Improved gas turbine engine efficiency can be obtained by operating at higher temperatures, however current operating temperatures in the turbine section exceed the melting points of the superalloy materials used in turbine components. Consequently, it is a general practice to provide air cooling. Cooling is typically provided by flowing relatively cool air from the compressor section of the engine through passages in the turbine components to be cooled. Such cooling comes with an associated cost in engine efficiency. Consequently, there is a strong desire to provide enhanced specific cooling, maximizing the amount of cooling benefit obtained from a given amount of cooling air. This may be obtained by the use of fine, precisely located, cooling passageway sections.

A well developed field exists regarding the investment casting of internally-cooled turbine engine parts such as blades, vanes, seals, combustors, and other components. In an exemplary process, a mold is prepared having one or more mold cavities, each having a shape generally corresponding to the part to be cast. An exemplary process for preparing the mold involves the use of one or more wax patterns of the part. The patterns are formed by molding wax over ceramic cores generally corresponding to positives of the cooling passages within the parts. In a shelling process, a ceramic shell is formed around one or more such patterns in a well known fashion. The wax may be removed such as by melting, e.g., in an autoclave. The shell may be fired to harden the shell. This leaves a mold comprising the shell having one or more part-defining compartments which, in turn, contain the ceramic core(s) defining the cooling passages. Molten alloy may then be introduced to the mold to cast the part(s). Upon cooling and solidifying of the alloy, the shell and core may be mechanically and/or chemically removed from the molded part(s). The part(s) can then be machined and/or treated in one or more stages.

The ceramic cores themselves may be formed by molding a mixture of ceramic powder and binder material by injecting the mixture into hardened metal dies. After removal from the dies, the green cores may then be thermally post-processed to remove the binder and fired to sinter the ceramic powder together. The trend toward finer cooling features has taxed ceramic core manufacturing techniques. The cores defining fine features may be difficult to manufacture and/or, once manufactured, may prove fragile.

A variety of post-casting techniques were traditionally used to form the fine features. A most basic technique is conventional drilling. Laser drilling is another. Electrical discharge machining or electro-discharge machining (EDM) has also been applied. For example, in machining a row of cooling holes, it is known to use an EDM electrode of a comb-like shape with teeth having complementary shape to the holes to be formed. Various EDM techniques, electrodes, and hole shapes are shown in U.S. Pat. No. 3,604,884 of Olsson, U.S. Pat. No. 4,197,443 of Sidenstick, U.S. Pat. No. 4,819,325 of Cross et al., U.S. Pat. No. 4,922,076 of Cross et al., U.S. Pat. No. 5,382,133 of Moore et al., U.S. Pat. No. 5,605,639 of Banks et al., and U.S. Pat. No. 5,637,239 of Adamski et al. The hole shapes produced by such EDM techniques are limited by electrode insertion constraints.

Commonly-assigned co-pending U.S. Pat. No. 6,637,500 of Shah et al. discloses exemplary use of a ceramic and refractory metal core combination. With such combinations, generally, the ceramic core(s) provide the large internal features such as trunk passageways while the refractory metal core(s) provide finer features such as outlet passageways. As is the case with the use of multiple ceramic cores, assembling the ceramic and refractory metal cores and maintaining their spatial relationship during wax overmolding presents numerous difficulties. A failure to maintain such relationship can produce potentially unsatisfactory part internal features. It may be difficult to assemble fine refractory metal cores to ceramic cores. Once assembled, it may be difficult to maintain alignment. The refractory metal cores may become damaged during handling or during assembly of the overmolding die. Assuring proper die assembly and release of the injected pattern may require die complexity (e.g., a large number of separate die parts and separate pull directions to accommodate the various RMCs).

Separately from the development of RMCs, various techniques for positioning the ceramic cores in the pattern molds and resulting shells have been developed. U.S. Pat. No. 5,296,308 of Caccavale et al. discloses use of small projections unitarily formed with the feed portions of the ceramic core to position a ceramic core in the die for overmolding the pattern wax. Such projections may then tend to maintain alignment of the core within the shell after shelling and dewaxing.

Nevertheless, there remains room for further improvement in core assembly techniques.

SUMMARY OF THE INVENTION

One aspect of the invention involves a method for forming an investment casting pattern. A first core is installed to a first element of a molding die to leave a first portion of the first core protruding from the first element. After the installing, the first element is assembled with a feed core and a second element of the molding die so that the first portion contacts the feed core and is flexed. A material is molded at least partially over the first core and feed core.

In various implementations, the assembling may include causing engagement between the first core and feed core to at least partially maintain an orientation of the feed core relative to the molding die. A second core may be installed to the second element to leave a first portion of the second core protruding from the second element. A second core may be installed to the first element to leave a first portion of the second core protruding from the first element. The first core may have a spine and a number of tines extending from the spine. The first core may comprise, in major weight part, one or more refractory metals. The feed core may comprise, in major weight part, one or more ceramic materials and/or refractory metals. The material may comprise, in major weight part, one or more waxes.

Another aspect of the invention involves a method for forming an investment casting mold. An investment casting pattern may be formed as described above. One or more coating layers may be applied to the pattern. The material may be substantially removed to leave the first core and feed core within a shell formed by the coating layers. The method may be used to fabricate a gas turbine engine airfoil element mold.

Another aspect of the invention involves a method for investment casting. An investment casting mold is formed as described above. Molten metal is introduced to the investment casting mold. The molten metal is permitted to solidify. The investment casting mold is destructively removed. The method may be used to fabricate a gas turbine engine component.

Another aspect of the invention involves a component for forming an investment casting pattern. The component includes a spine and a number of tines extending from the spine.

In various implementations, the spine and tines may be unitarily formed and may consist essentially of a refractory metal-based material, optionally coated. The tines may be tapered over a first region from a relatively wide cross-section proximal root at least to a relatively small cross-section intermediate location. The tines may be less tapered over a second region, distally of the first region. The spine may have integrally-formed spring elements. There may be at least six such tines. The spine may provide at least 90% of a mass of the component. The tines may be at least five mm in length. The spine may define a direction of insertion for inserting the spine into a die. The tines may extend off-parallel to the direction of insertion.

The details of one or more embodiments of the invention are set forth in the accompanying drawings and the description below. Other features, objects, and advantages of the invention will be apparent from the description and drawings, and from the claims.

BRIEF DESCRIPTION OF THE DRAWINGS

Like reference numbers and designations in the various drawings indicate like elements.

DETAILED DESCRIPTION

Figure 1:
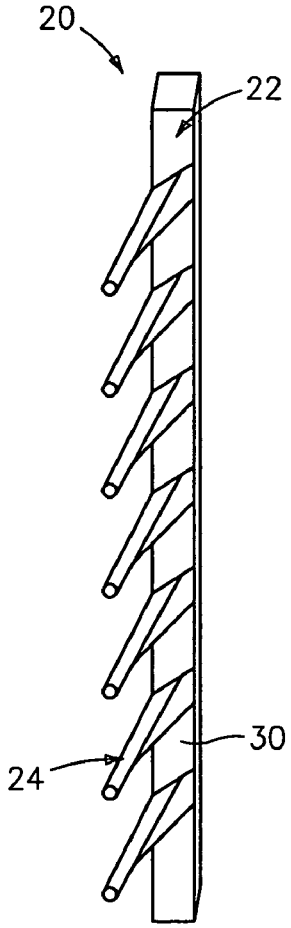
FIG. 1 is a view of a refractory metal core (RMC)

FIG. 1 shows an exemplary refractory metal core (RMC) 20 which may include a refractory metal substrate and, optionally, a coating (e.g., ceramic). Exemplary RMC substrate materials include Mo, Nb, Ta, and W alone or in combination and in elemental form, alloy, intermetallic, and the like. The RMC 20 may be formed by any of a variety of manufacturing techniques, for example, those used to form EDM comb electrodes. For example, the substrate may be formed by milling from a refractory metal ingot or stamping and bending a refractory metal sheet, or by build up using multiple sheets. The substrate may then be coated (e.g., with a full ceramic coating or a coating limited to areas that will ultimately contact molten metal). The exemplary RMC 20 is intended to be illustrative of one possible general configuration. Other configurations, including simpler and more complex configurations are possible. A core precursor could be manufactured having a spine and tines and individual cores separated from the precursor, with the individual cores each having one or more of the tines. Individual cores with one to a few tines could be useful, for example, where only isolated holes or small groups thereof are desired or where it is desired that the holes be of varying shape/size, staggered out of line, of varying spacing, and the like.

Figure 2:
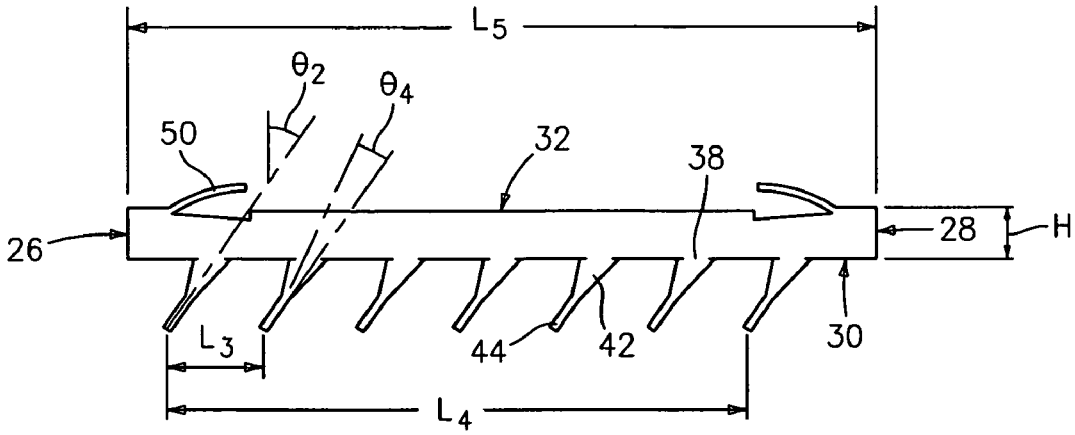
FIG. 2 is a front view of the RMC of FIG. 1.

The exemplary RMC 20 maybe comb-like, having a back or spine 22 and a row of teeth or tines 24 extending therefrom. Other forms are possible. A spine 22 extends between first and second ends 26 and 28 (FIG. 2) and has inboard and outboard surfaces or edges 30 and 32. In the exemplary embodiment, the teeth 24 extend from the inboard surface 30. An exemplary number of teeth is 4-20, more narrowly, 6-12. The exemplary spine is formed as a portion of a generally right parallelepiped and thus has two additional surfaces or faces 34 and 36. In the exemplary implementation, the face 34 is a forward face and the face 36 is an aft face (with fore and aft corresponding to generally upstream and downstream positions in an exemplary airfoil to be cast using the RMC 20). The exemplary teeth 24 each extend from a proximal root 38 at the inboard surface 30 to a distal tip 40. The exemplary teeth each have a proximal portion 42 and a distal portion 44 meeting at an intermediate junction 46. The exemplary distal portion 44 is of relatively constant cross-sectional area and shape (e.g., circular or rounded square shape) and extends along a median axis 500 with a length $L_1$. The proximal portion 42 is of generally proximally divergent cross-sectional area and has a median axis 502 and a characteristic length $L_2$. The proximal portion may be of generally relatively non-constant cross-sectional shape (e.g., transitioning from the shape of the distal portion to an aftward/downstream divergent shape such as a triangle with a rounded leading corner). Nevertheless, the distal portion could have a non-constant shape and the proximal portion could have a constant shape. Alternatively the entire tine could have constant cross-section.

In the exemplary embodiment, a tooth-to-tooth pitch $L_3$ is defined as the tip separation of adjacent teeth. The pitch may be constant or varied as may be the length and cross-sectional shape and dimensions of the teeth. For example, these parameters may be varied to provide a desired cooling distribution. The array of teeth has an overall length $L_4$. The spine has an overall length $L_5$, a thickness T, and a principal height H. These parameters may be chosen to permit a desired tooth/hole distribution in view of economy factors (e.g., it may be more economical in labor savings to have one RMC with many teeth rather than a number of RMCs each with a lesser number of teeth). The exemplary spine has a pair of arcuate spring tabs 50 extending above a principal portion of the outboard surface 32 opposite the tines (e.g., cut and bent from a remaining portion of the spine).

Figure 3:
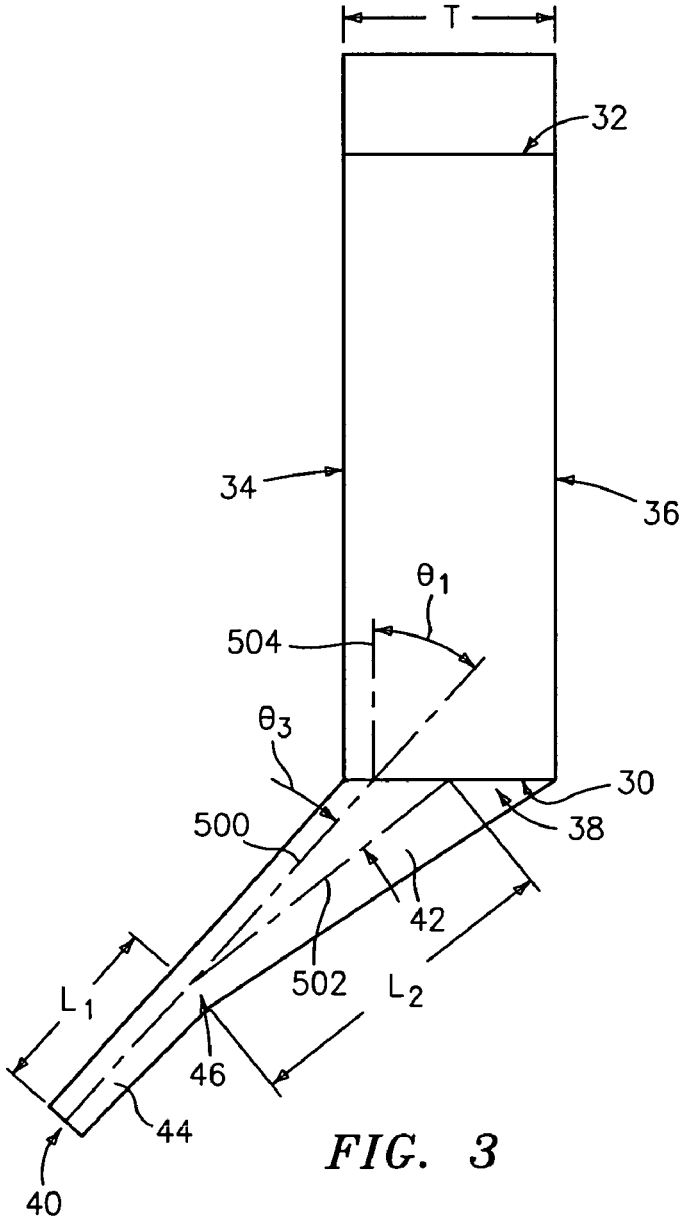
FIG. 3 is an end view of the RMC of FIG. 1.

In the exemplary embodiment, the distal portions 44 may extend at an angle $\theta_1$ (FIG. 3) relative to a direction 504 which may be orthogonal to the outboard surface 32 when viewed from the side and an angle $\theta_2$ (FIG. 2) when viewed from the front. Similarly, the distal and proximal portions may be at angles $\theta_3$ and $\theta_4$ from each other when viewed from these directions. $\theta_1$-$\theta_4$ need not be the same for each tooth.

Figure 4:
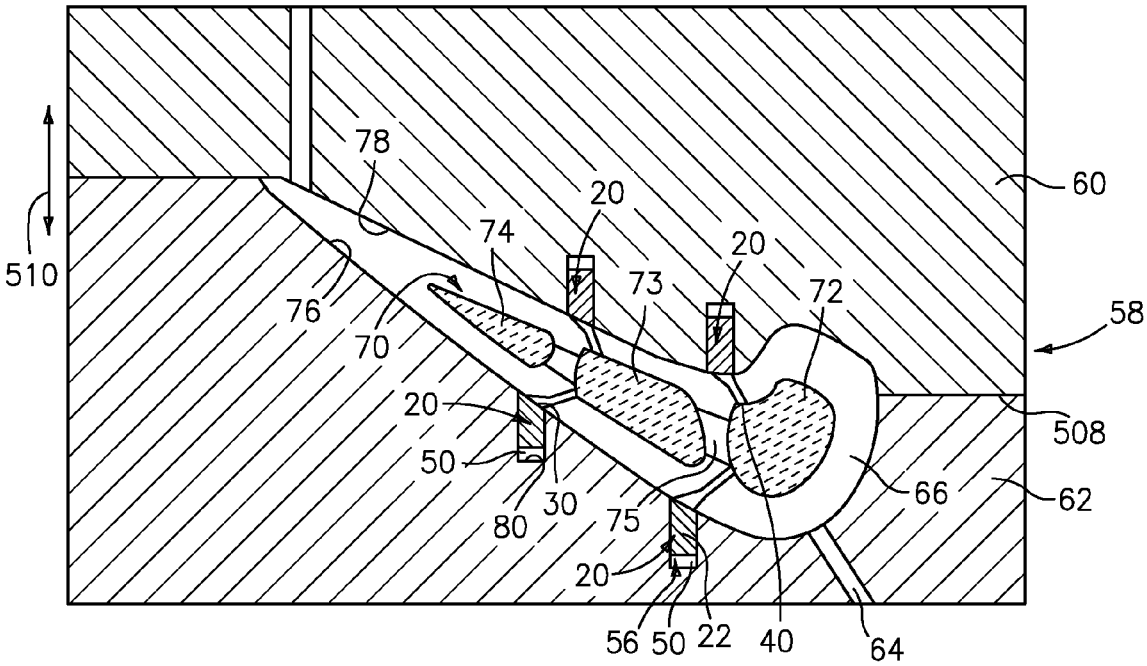
FIG. 4 is a sectional view of a die for wax molding a core assembly.

FIG. 4 shows a number of such RMCs 20 positioned with their spines 22 in compartments 56 of a pattern-forming die 58 having first and second halves 60 and 62. The compartments may be shaped and dimensioned to precisely orient and position the associated spines. The exemplary die halves are formed of metal or of a composite (e.g., epoxy-based). The die halves are shown assembled, meeting along a parting junction 508. The die halves may have passageways 64 for the introduction of wax to a void 66 and may be joined and separated along a pull direction 510 which may correspond with the direction 504 of each of the RMCs.

FIG. 4 further shows a ceramic feed core 70 having portions 72, 73, and 74 (e.g., joined by webs 75) for forming three spanwise feed passageways in an airfoil of the part (e.g., a turbine blade or vane) to be cast. Alternative feed cores may be made of other materials such as refractory metals or ceramic/refractory combinations or assemblies. The die includes surfaces 76 and 78 for forming suction and pressure side surfaces of the pattern airfoil. The inboard surfaces 30 are advantageously shaped and angled to generally correspond to their associated surface 76 or 78. However, portions of the spines could protrude beyond an otherwise continuous curve of the associated surface (e.g., to ultimately form the cast part with a shallow slot connecting outlets of through-holes formed by the tines.

In the exemplary embodiment, the tips 40 contact the feed core and help position the feed core. Many different assembly techniques are possible. For example, the RMCs may be placed in the associated die halves and the feed core then lowered into place and engagement with the RMCs of the lower half (e.g., 62). Thereafter, the upper half may be joined via translation along the pull direction 510, bringing its associated RMCs into engagement with the feed core. Other RMCs of other forms may also be installed during the mold assembly process or may be preinstalled to the feed core. The tips may be slightly resiliently flexed during the mold assembly process to help position the feed core either during wax molding or later (as described below). The flexion may be maintained by cooperation of the spring tabs 50 with base portions 80 of the compartments 56 so as to bias the tips 40 into contact with the feed core. Optionally, the feed core 70 may have recesses for receiving the tips 40 which may improve tip positioning relative to the feed core.

Figure 5:
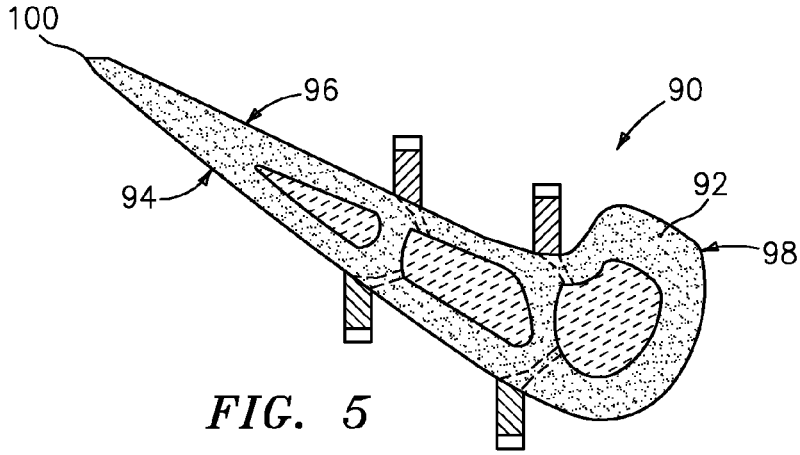
FIG. 5 is a sectional view of an airfoil of a pattern molded in the die of FIG. 4.

FIG. 5 shows the pattern 90 after the molding of wax 92 and the removal of the pattern from the die 58. The pattern has an exterior surface characterized by suction and pressure side surfaces 94 and 96 extending between a leading edge 98 and a trailing edge 100. Advantageously, the strain/flexing of the RMCs during the wax molding process is sufficiently low so that the wax is sufficiently strong to maintain the relative positioning and engagement of the RMCs and feed core 70.

Figure 6:
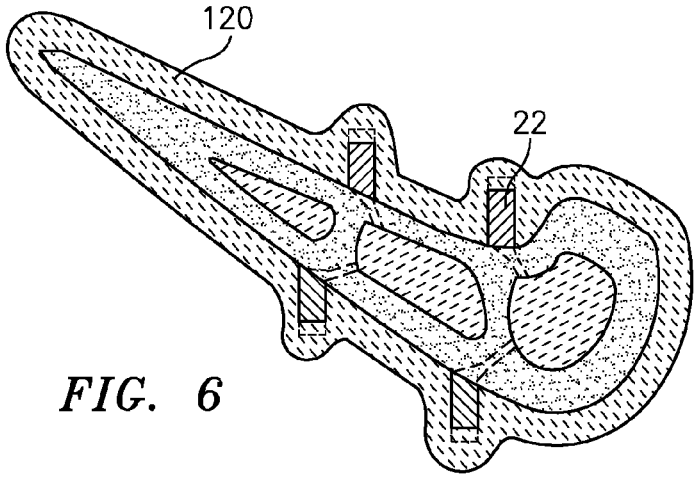
FIG. 6 is a sectional view of a shelled pattern from the precursor of FIG. 5.
Figure 7:
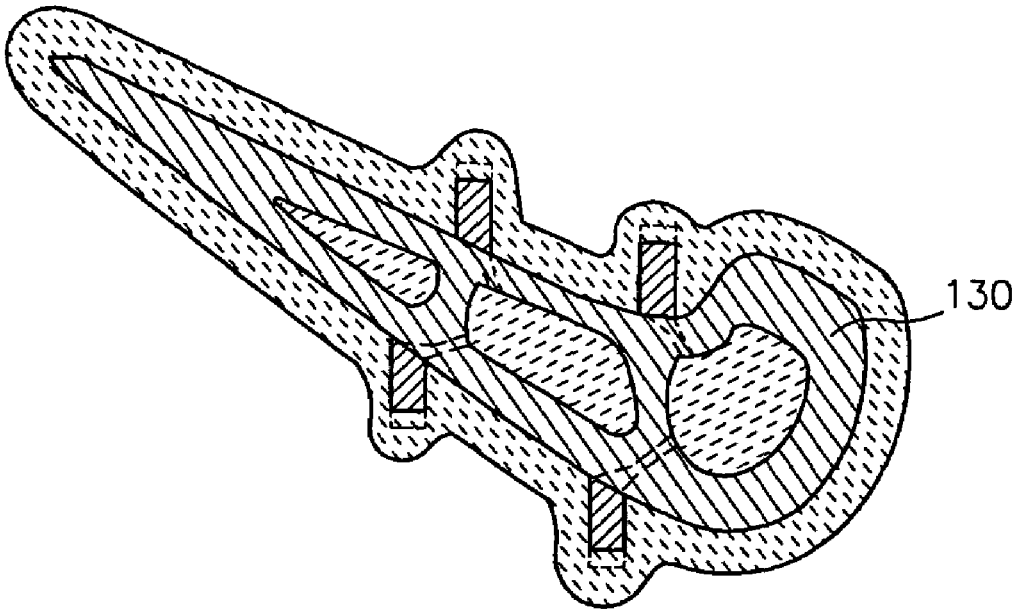
FIG. 7 is a sectional view of cast metal in a shell formed from the shelled pattern of FIG. 6.

After any further preparation (e.g., trimming, patching, and the like), the pattern may be assembled to a shelling fixture (e.g., via wax welding between upper and lower end plates of the fixture) and a multilayer ceramic slurry/stucco coating 120 (FIG. 6) applied for forming a shell. The RMC body portions 22 become embedded in the shell 120. After the coating dries, a dewax process (e.g., in a steam autoclave) may remove the wax from the pattern leaving the RMCs 20 and feed core 70 within the shell. This core and shell assembly may be fired to harden the shell. Molten casting material 130 (FIG. 7—e.g., for forming a nickel—or cobalt-based superalloy part) may then be introduced to the shell to fill the spaces between the core assembly and the shell. During the dewaxing, firing, and/or casting material introduction and cooling, the RMCs 70 may continue to help maintain the desired position/orientation of the feed core 70.

Figure 8:
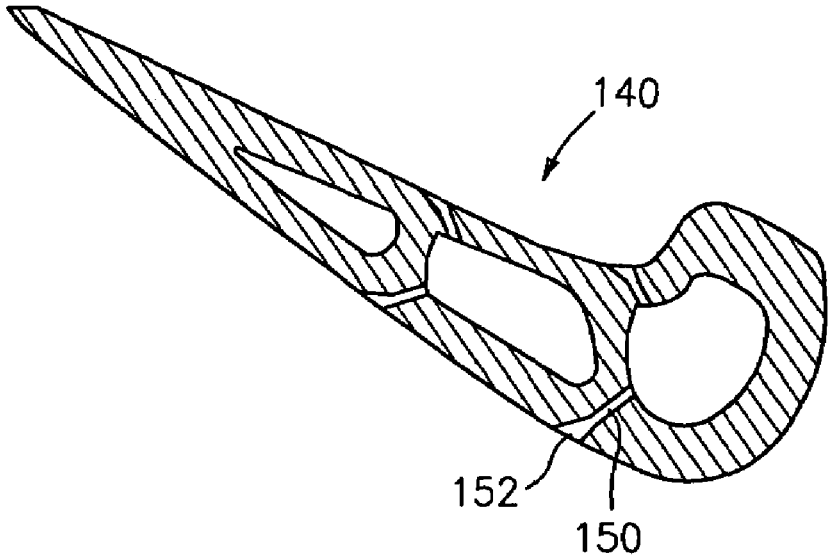
FIG. 8 is a sectional view of a part formed by the cast metal of FIG. 7.

After solidification of the casting material, the shell 120 may be destructively removed (e.g., broken away via an impact apparatus and/or chemical immersion process) and the RMCs and feed core destructively removed (e.g., via a chemical immersion apparatus) from the cast metal to form a part precursor (e.g., a rough or unfinished part) 140 (FIG. 8). Thereafter, the precursor may be subject to machining, treatment (e.g., thermal, mechanical, or chemical), and coating (e.g., metallic environmental coating/bond coat and/or ceramic heat resistant coating) to form the final component.

FIG. 8 further shows the discharge cooling passageways formed by the RMC teeth. The passageways each have a small cross-section upstream metering portion 150 formed by the teeth distal portions and a downstream diffusing portion 152 formed by the teeth proximal portions. Such portions may have shape and dimensions as are known in the art or may yet be developed. For example, passageways with arcuate (e.g., non-constant radius of curvature) longitudinal sections, passageways with twist or with at least local downstream-wise decrease in cross-section, or otherwise convoluted passageways, may be formed which might be impossible to form via drilling or EDM.

Exemplary overall tine lengths are 0.5-13 mm, more narrowly 3.0-7.0 mm, depending essentially upon the wall thickness of the part and the overall tine angle relative to the part outer surface. For the basic illustrated passageway/tine construction, exemplary tine distal portion axes (and thus passageway metering portions) are 15-90° off the part outer surface, more narrowly 20-40°. Exemplary cross-sectional areas of the metering portions are 0.03-0.8 $mm^2$. Exemplary maximum transverse dimensions of the metering portions are 0.2-1.0 mm.

Figure 9:
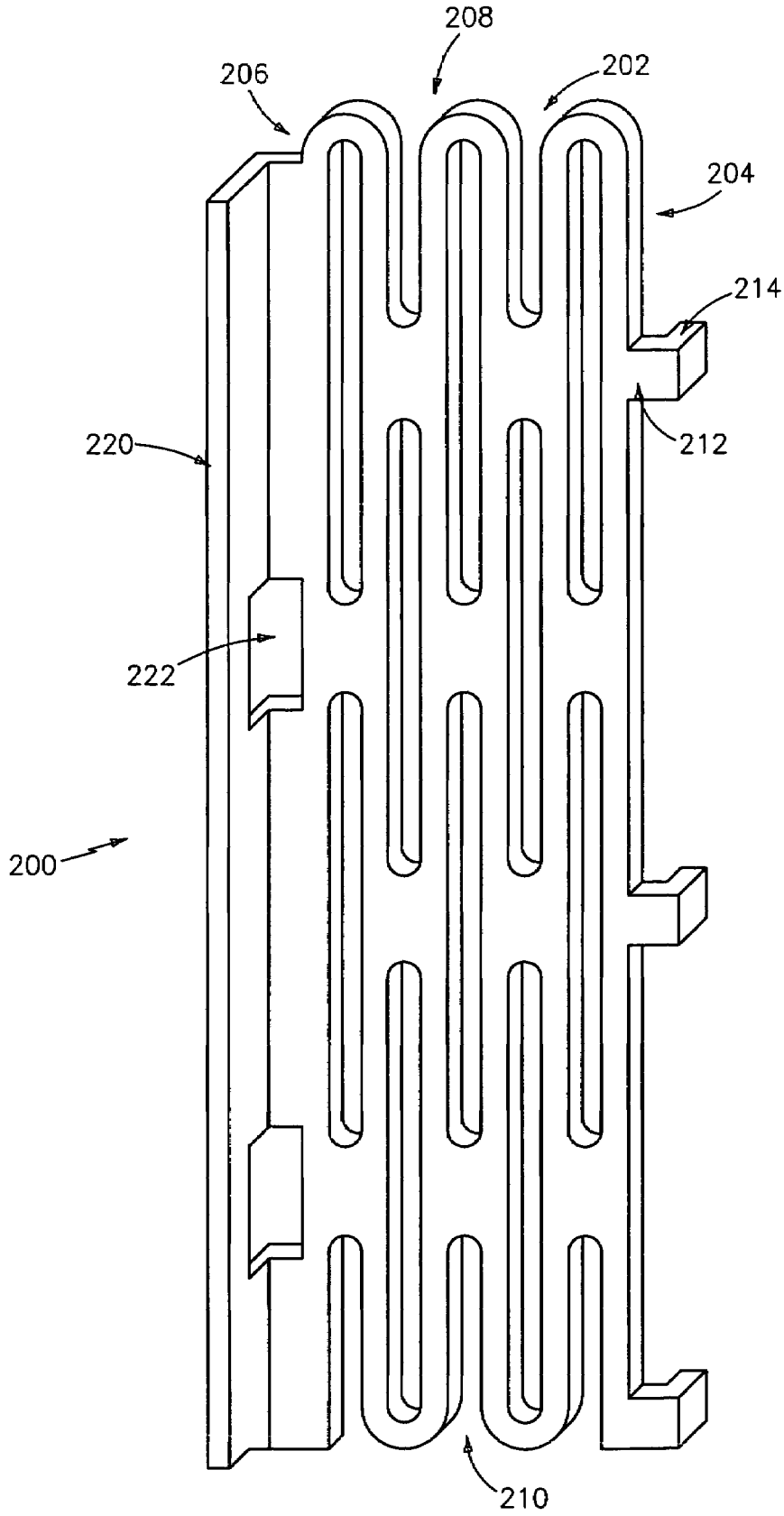
FIG. 9 is a view of an alternate RMC.

In alternative embodiments, one or more of the tines may intersect each other to form intersecting passageways in the cast part. FIG. 9 shows an alternate RMC 200 which may be stamped and bent from sheet stock. The RMC 200 has a generally flat main body portion 202 extending from an upstream end 204 to a downstream end 206 and having first and second lateral ends 208 and 210. At the upstream end 204, the main body portion has a number of projections 212 for forming inlets to a serpentine passageway system in the cast part formed by ultimate removal of the main body portion 202. Each projection 212 is continuous with a feed core-engagement portion 214 extending at an angle off-parallel to the main body portion and which may be received in a complementary pocket in the feed core.

A spine 220 is formed adjacent the downstream end 206. Apertures 222 interrupt a proximal portion of the spine 220 and a downstream portion of the body 202. The apertures ultimately form intact casting portions between outlet slots in a similar fashion to outlet slots disclosed in U.S. Pat. No. 6,705,831. Prior to pattern forming, the spine 220 may be positioned within a complementary compartment of the pattern-forming die and brought into flexed engagement with the associated feed core(s) during die assembly.

The foregoing teachings may be implemented in the manufacturing of pre-existing patterns (core combinations and wax shapes) or to produce novel patterns not yet designed.

One or more embodiments of the present invention have been described. Nevertheless, it will be understood that various modifications may be made without departing from the spirit and scope of the invention. For example, details of the particular components being manufactured will influence or dictate details of any particular implementation. Thus, other core combinations may be used, including small and/or finely-featured ceramic or other cores in place of the RMCs.

Dies having more than two parts may be used. Accordingly, other embodiments are within the scope of the following claims.

What is claimed is:

1. A combination comprising:

a component for forming an investment casting pattern comprising:

a spine having:

first and second faces;

first and second edges; and first and second ends;

a plurality of tines extending from the first edge of the spine; and spring elements integrally formed with the spine and extending from the second edge and positioned to transmit a bias force through the tines; and a pattern forming die having a receiving compartment, the spine being partially accommodated in the receiving compartment.

2. The combination of claim 1 wherein:

the spine and the plurality of tines are unitarily formed and consist essentially of a refractory metal-based material, optionally coated.

3. The combination of claim 1 wherein:

the tines are tapered from a relatively wide cross-section proximal root at least to a relatively small cross-section intermediate location.

4. The combination of claim 1 wherein:

the tines are non-intersecting.

5. The combination of claim 1 wherein:

at least two of the tines intersect each other.

6. The combination of claim 1 wherein:

the tines are tapered over a first region from a relatively wide cross-section proximal root at least to a relatively small cross-section intermediate location; and the tines are less tapered over a second region, distally of the first region.

7. The combination of claim 1 wherein:

the spine has exactly two said integrally-formed spring elements.

8. The combination of claim 1 wherein:

there are at least six such tines.

9. The combination of claim 1 wherein:

the spine provides at least 90% of a mass of the component.

10. The combination of claim 1 wherein:

the tines are at least five mm in length.

11. The combination of claim 1 wherein:

the spine defines a direction of insertion for inserting the spine into a die; and the tines extend off-parallel to said direction of insertion.

12. The combination of claim 1 wherein:

the tines are at a non-constant spacing; and one or more of the tines extend off-parallel to one or more others of the tines.

13. The combination of claim 1 wherein:

the integrally formed spring elements are held flexed within the receiving compartment.

14. The combination of claim 1 further comprising:

a ceramic core contacted by the component.

15. The combination of claim 14 wherein:

the component is held biased against the ceramic core.

16. A component for forming an investment casting pattern comprising:

means for mounting the component in a pattern-forming die and biasing the component into engagement with a casting core; and means extending from the spine for forming passageways through a member cast from the pattern.

17. A component for forming an investment casting pattern comprising:

a spine having means for biasing the component into engagement with a casting core, and comprising integrally-formed spring elements; and a plurality of tines extending from the spine.

18. The component of claim 17 wherein:

the spring elements are opposite the tines.

19. The component of claim 17 wherein:

the tines are in a single row.

20. The component of claim 17 wherein:

the spring elements are arcuate tabs.

21. A combination comprising:

a component for forming an investment casting pattern comprising:

a spine; and a plurality of tines extending from the spine; and a pattern-forming die having a receiving compartment, wherein:

the spine is partially accommodated in the receiving compartment; and the spine has at least one integrally formed spring element held flexed within the receiving compartment.

* * * * *